United States Patent [19]

Albert et al.

[11] 4,276,714

[45] Jul. 7, 1981

[54] DOLL INCLUDING MECHANISM FOR SUCKING ACTION AND SOUNDS

[75] Inventors: Judith Albert, Mill Neck, N.Y.; Janos Beny, Torrance, Calif.

[73] Assignee: Ideal Toy Corporation, Hollis, N.Y.

[21] Appl. No.: 86,603

[22] Filed: Oct. 19, 1979

[51] Int. Cl.[3] ..... A63H 5/00

[52] U.S. Cl. ..... 46/118; 46/141

[58] Field of Search ..... 46/118, 141, 264, 266, 46/135 R, 117, 119, 116

[56] References Cited

U.S. PATENT DOCUMENTS

| | | | |
|---|---|---|---|
| 2,818,678 | 1/1958 | Lemelson | 46/118 |
| 3,383,795 | 5/1968 | Ryan et al. | 46/141 X |
| 3,514,899 | 6/1970 | Bonanno et al. | 46/264 X |
| 4,114,313 | 9/1978 | Guerrero et al. | 46/118 X |

FOREIGN PATENT DOCUMENTS

| | | | |
|---|---|---|---|
| 2847629 | 11/1979 | Fed. Rep. of Germany | 46/141 |
| 2366855 | 5/1978 | France | 46/141 |

*Primary Examiner*—Gene Mancene
*Assistant Examiner*—Mickey Yu
*Attorney, Agent, or Firm*—Richard M. Rabkin

[57] ABSTRACT

The toy doll includes a body and a movable head having a mouth opening formed therein. A drive mechanism is contained within the doll's body for oscillating the head in a forward and aft direction in response to the insertion of an object into the doll's mouth opening. Simultaneously, oscillation of the doll's head operates a pair of cymbals for producing sounds simulating those of a child sucking on a bottle.

10 Claims, 8 Drawing Figures

DOLL INCLUDING MECHANISM FOR SUCKING ACTION AND SOUNDS

The present invention relates to toy dolls, and in particular to a toy doll which can simulate the actions and sounds of an infant drinking a bottle.

A variety of different types of infant dolls which are adapted to simulate the actions of a child drinking a bottle have been previously proposed. Such dolls include those whose face will deform upon insertion of a bottle in the doll's mouth, and others, such as shown, for example, in the U.S. Pat. No. 3,918,199 whose facial features will be continually deformed to simulate a sucking action. The latter patent also discloses the concept of providing a sound mechanism in the doll to recreate the sounds of a child crying prior to drinking. That doll, however, provides separate mechanisms for the control of the sound and the sucking action. And, the two actions do not take place simultaneously.

It is an object of the present invention to provide a toy doll which will simulate the head motions of an infant drinking a bottle.

Another object of the present invention is to provide a toy doll which will simulate the sounds of an infant drinking a bottle while the doll's head moves.

A further object of the present invention is to provide a toy doll which will produce sounds in response to oscillation of the doll's head.

Yet another object of the present invention is to provide a toy doll of the character described which is relatively simple in construction and durable in operation.

A still further object of the present invention is to provide a toy doll of the character described which is relatively simple and inexpensive to manufacture.

In accordance with an aspect of the present invention, the toy doll includes a body and a head operatively connected to the body for oscillating movement in a fore and aft direction. The head has a mouth opening formed therein and a neck portion in which a rigid neck block is mounted.

A drive motor is located in the body and means are operatively engaged between the drive motor and the neck block for oscillating the neck block and the head in a fore and aft direction when the body is held. Releasable locking means are located in the head for normally preventing oscillation of the head by the drive motor. The releasable locking means includes a slide block responsive to the insertion of an object in the doll's mouth opening to release the locking means and permit the drive motor to oscillate the head. A pair of cymbals are mounted in the doll's head such that oscillation of the neck block causes one of the cymbals to move with respect to the other cymbal to produce a child-like sound simulating the sound of an infant sucking on a bottle.

The above, and other objects, features and advantages of this invention will be apparent in the following detailed description of an illustrative embodiment thereof, which is to be read in connection with the accompanying drawings wherein.

Figure 1:
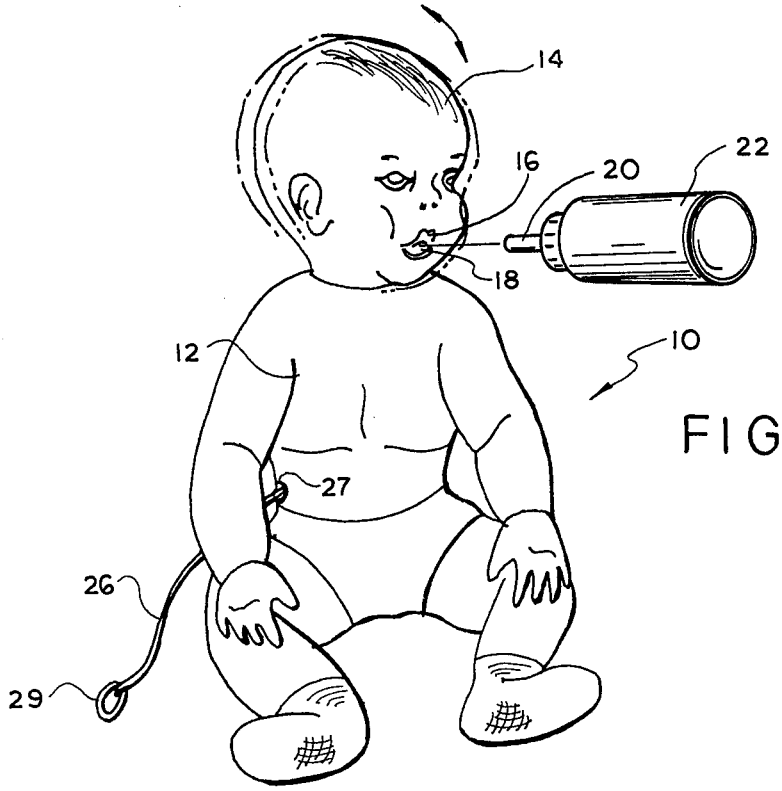
FIG. 1 is a perspective view of a toy doll constructed in accordance with the present invention.

Referring now to the drawing in detail, and initially to FIG. 1 thereof, a toy doll 10 constructed in accordance with the present invention includes a body 12 and a head 14. The doll's head is formed of molded flexible plastic construction in the conventional manner, while the body is formed of stuffed fabric. The body is secured to the head by a tightened band 15 around the doll's neck as described hereinafter.

The doll's head 14 includes a mouth 16 formed on its face, having an opening 18 therein through which the nipple 20 on a bottle 22 may be inserted. A drive mechanism 24 is contained within the doll's body 12 for oscillating the head 14 in a fore and aft direction when the body is held and the nipple 20 of bottle 22 is inserted in the doll's mouth. The drive mechanism is operated upon the charging of a spring motor therein when the user pulls the cord 26 of the motor which extends out of the doll's body.

Figure 2:
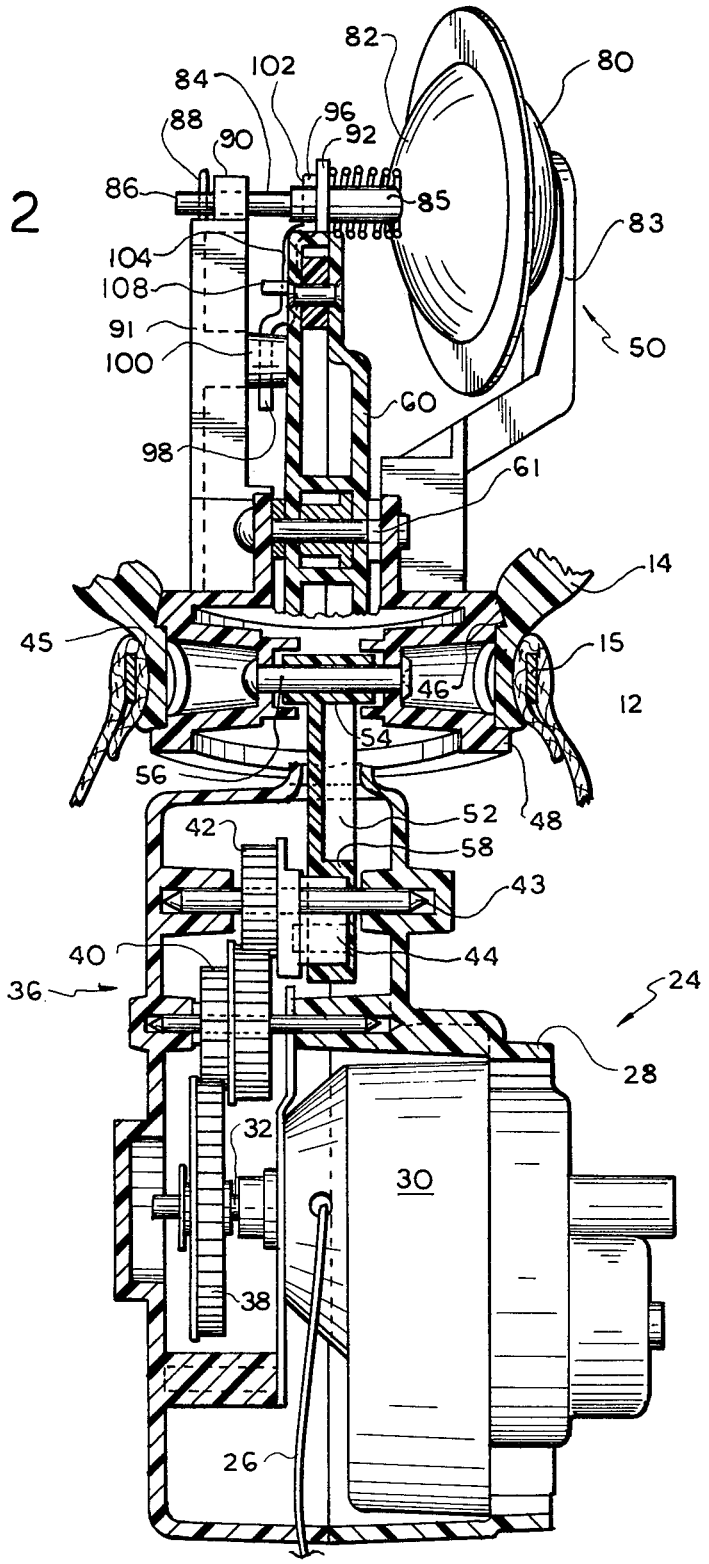
FIG. 2 is a rear view, in section, of the mechanism mounted within the doll's head and body for oscillating the doll's head and producing the child-like sounds.

Referring to FIG. 2 of the drawings, drive mechanism 24 is shown in greater detail. This mechanism includes a casing 28 which is located within the stuffed body 12 but which is not connected to the body. The casing encloses a negator spring motor 30 of conventional construction in which a coiled negator spring is connected to a drive shaft 32. The spring is wound in the known manner when pull cord 26 is drawn out of the casing. The cord 26 extends through an opening 27 in the doll'body and has a pull ring 29 on its free end. After the pull cord is drawn from the body and released negator spring is free to unwind and drive rotary output shaft 32. The unwinding of the spring, and thus oscillation of the doll's head, is controlled by a locking mechanism 34 contained within the doll's head, as described hereinafter.

A gear transmission 36 is mounted within casing 28 in order to produce approximately three oscillations of the head to one revolution of shaft 32. This transmission includes a first gear 38 mounted on shaft 32 and engaged with the smaller gear of the compound gear 40 rotatably mounted in casing 28. The larger gear of the compound gear is engaged with a spur gear 42 rotatably mounted on a shaft 43 is also rotatably mounted in casing 28. Spur gear 42 has an eccentric drive ring 44 integrally formed therewith.

Head 14 has a lower neck portion 45 having an opening 46 formed therein. A rigid neck block 48 is mounted in the opening 46 and supports the locking mechanism 34 as well as a sound-producing mechanism 50, described hereinafter. The neck portion of the head surrounds the exterior of block 48. The body is secured to the head by the band 15 which is contained within a hem in the upper end of the fabric body.

Figure 3A:
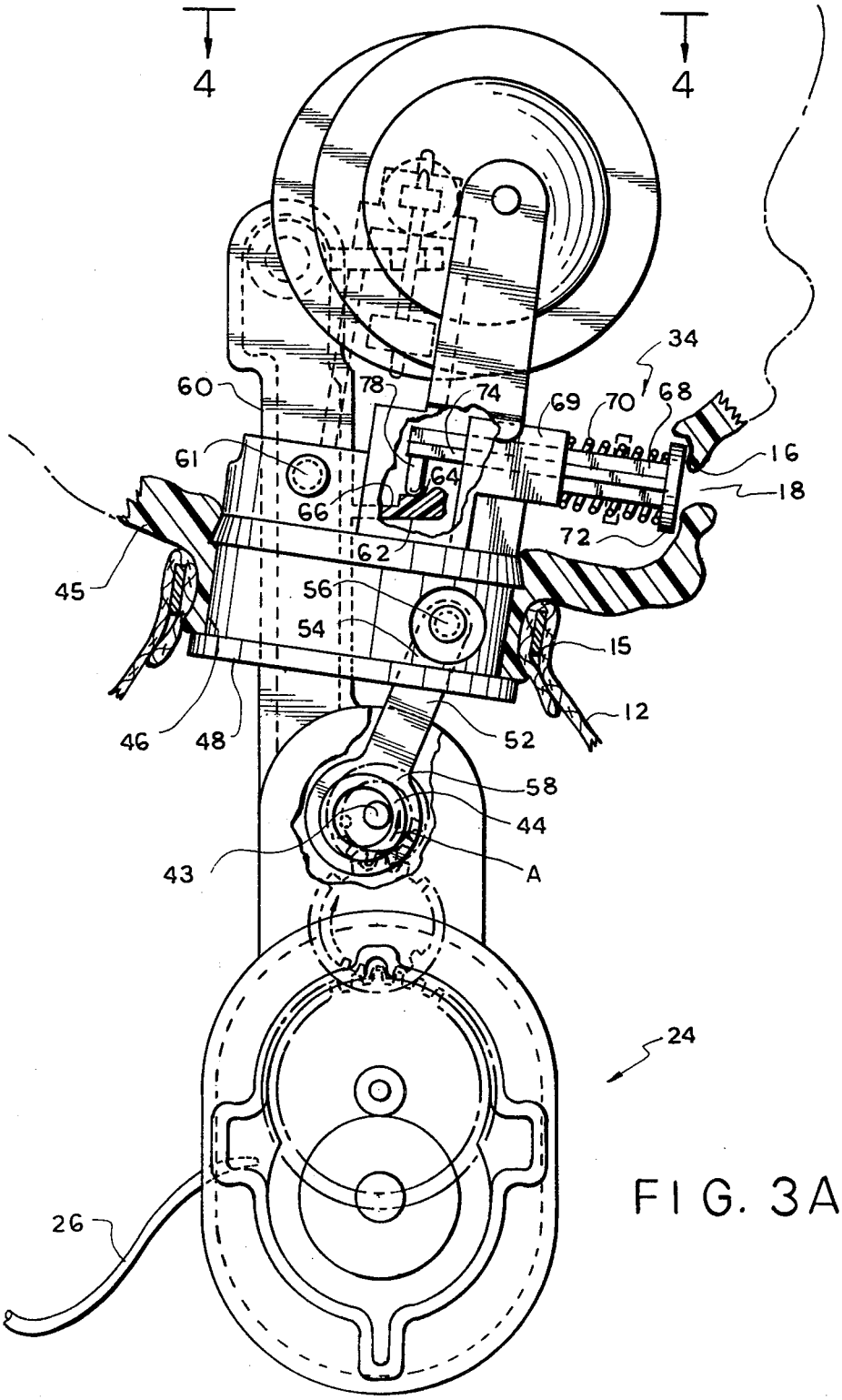
FIGS. 3A–3C are similar side sectional views of the mechanism shown in FIG. 2, in three different positions of the mechanism, to illustrate the operation thereof.

A pitman 52 is pivotally connected at one end 54 thereof through a pin 56 or the like to neck block 48 in a position forwardly of the central vertical axis of the neck block. The opposite end of the pitman includes a crank ring 58 which receives eccentric ring 44 of gear 42. With this arrangement the pitman will oscillate the neck block, and thus the doll's head 14, in a fore and aft direction between the extreme position shown in FIGS. 3B and 3C when the body is held (thereby to prevent movement of casing 28) and locking mechanism 34 is released. FIG. 3A shows the position of the doll's head when the drive is locked.

Casing 28 includes a vertical extension 60 that passes through neck block 46 into head 14. The neck block 46 is pivotally connected to extension 60 by a pivot pin 61, rearwardly of the location of the pivot pin 56.

Extension 60 includes a stop member or platform 62 integrally formed therewith which extends forwardly towards the doll's mouth. The stop 62 includes a stop surface 64 and a recess 66. The stop forms part of locking mechanism 34, which includes a slide block 68. The latter is slidably mounted for movement in a fore and aft direction with respect to mouth opening 18 in a collar 69 integrally formed with the neck block. The slide is biased towards its first or outermost position, shown in FIG. 3A, by a coil spring 70 engaged between collar 69 and an annular flange 72 formed on the mouth end of the slide. The slide is of generally cruciform cross-section and its outer position, shown in FIG. 3A, is defined or limited by an extension arm 74 which engages the rear face 76 of collar 69. A depending abutment member 78 is formed on the inner free end of slide 68 and, in the position shown in FIG. 3A, is located above and in engagement with the stop surface 64 of stop 62. In this position abutment 78 will prevent downward movement of the neck block under the influence of the drive motor. That is, since slide element 68 is mounted for oscillation with the neck block, rotation of eccentric ring 44 in the direction of the arrow A of FiG. 3A (this is the drive direction of the motor when operated) would cause pitman 52 to rotate the neck block, and thus slide element 68, downwardly in FIG. 3A, from the position shown therein to the position shown in FIG. 3B. However, with abutment 78 engaged against surface 64, such downward movement is prevented. This causes the drive motor to stall and prevents the spring therein from unwinding.

Figure 3B:
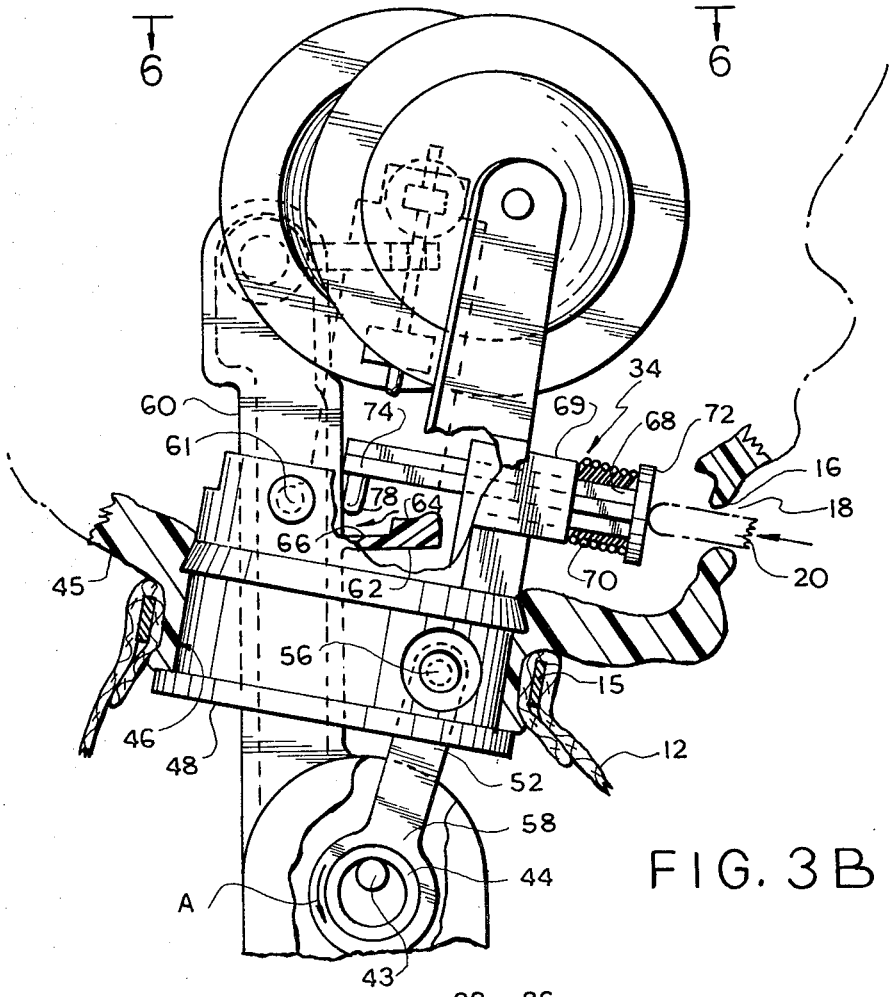
Figure 3C:
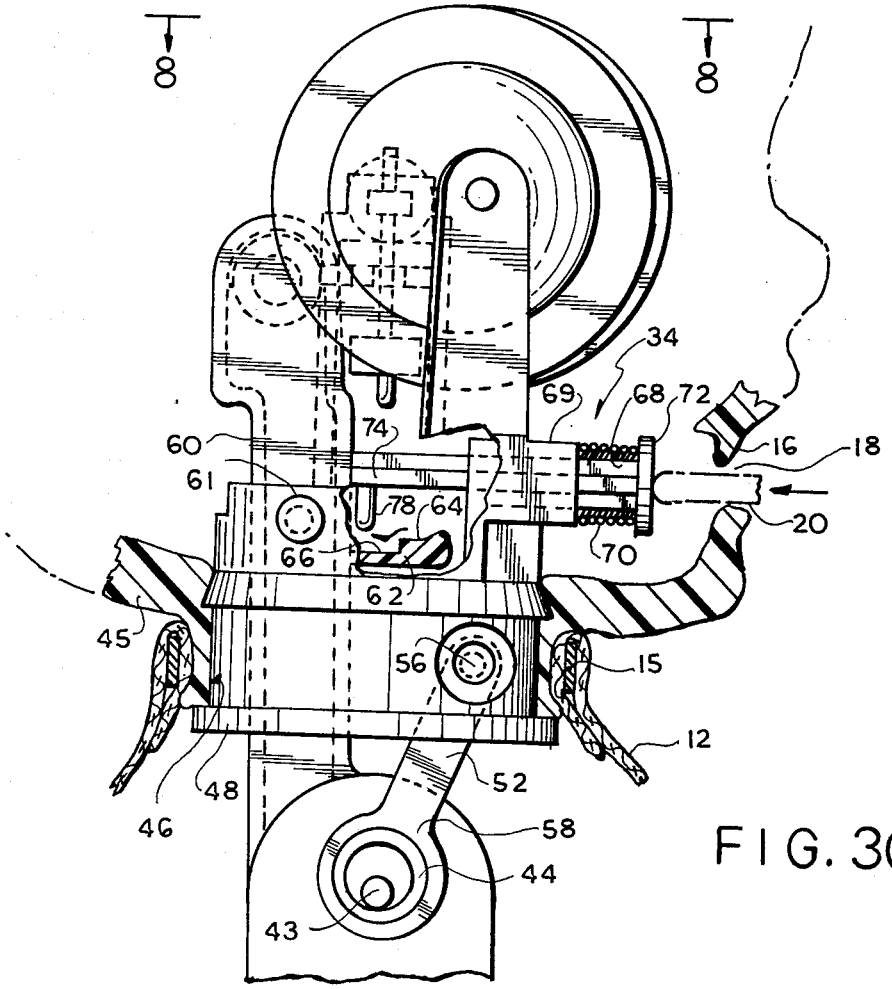

Upon insertion of nipple 20 in the mouth opening 18, slide block 68 is moved from its first position, shown in FIG. 3A, to its second position, shown in FIG. 3B. In this position abutment 78 is located inwardly of the stop surface 64 above recess 66 and thus frees the neck block for downward movement into the extreme lower position thereof, shown in FIG. 3B, under the influence of the drive motor.

In use, when the child pulls cord 26 motor 30 is energized and oscillation of the doll's head is prevented because of the engagement of abutment 78 against surface 64. When the nipple is inserted in the doll's mouth, engagement of abutment 78 and surface 64 is released and the doll's head can now move downwardly. As long as the nipple remains in the doll's mouth motor 30 will continue to operate and drive eccentric ring 44, causing neck block 46 to oscillate about pivot pin 61 between the lowest position thereof shown in FIG. 3B and the highest position thereof, shown in FIG. 3C. When the bottle is removed from the doll's mouth slide element 68 returns to its first position relative to the mouth, shown in FIG. 3A, and the motor will continue to operate until eccentric 44 reaches the position shown in FIG. 3A, wherein it has moved abutment pin 78 back into engagement with surface 64, preventing further oscillation of the neck block.

Figure 4A:
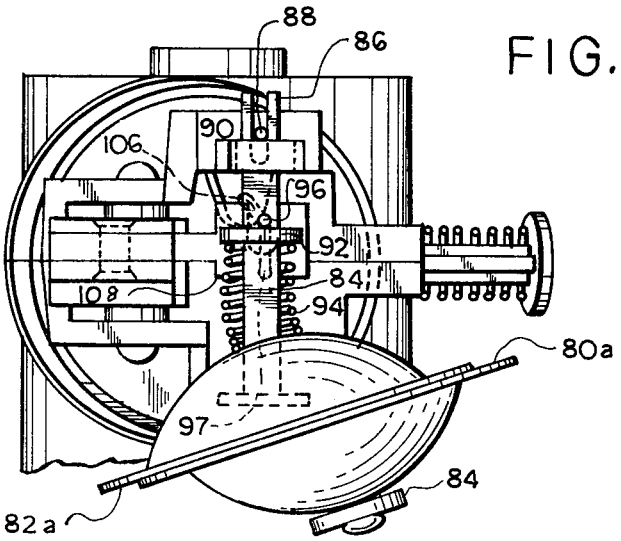
FIGS. 4A–4C are top plan views of the mechanism shown in FIG. 2, corresponding respectively to the positions of the mechanism shown in FIGS. 3A–3C.
Figure 4B:
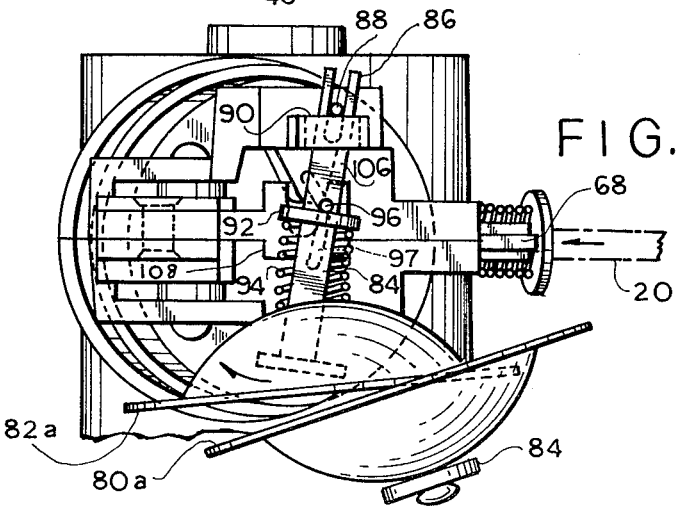
Figure 4C:
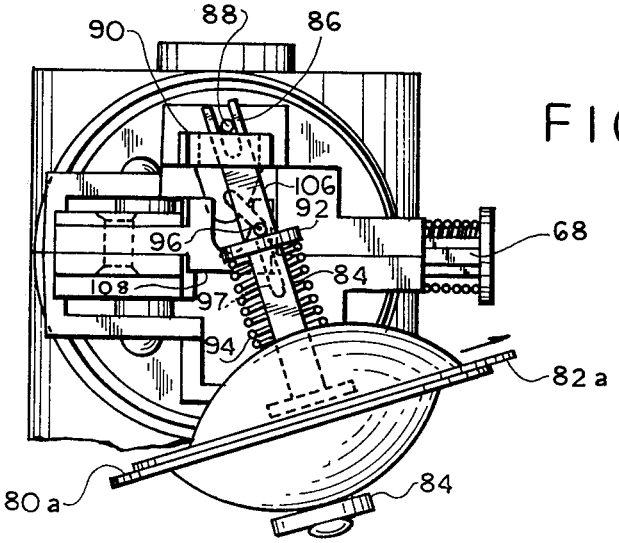

The sound-producing mechanism 50 includes a pair of cymbals 80, 82. Cymbal 80 is mounted on a rigid extension 83 of neck block 46. The cymbals are of conventional metallic construction and have their flat annular faces 80*a*, 82*a* in juxtaposition to each other, as shown in FIGS. 4A–4C.

Cymbal 82 has a central opening 85 formed therein which slidably receives a lever element 84. This lever element has a split free end 86, opposite cymbal 82, that receives a pivot pin 88 therein. In addition, the end 86 is captured against vertical movement in a slotted block 90 integrally formed on an extension 91 of the neck block. The slotted block 90 permits lever 84 to pivot about pin 88, between the positions shown in FIGS. 4B and 4C.

Lever 84 includes an annular washer 92 mounted thereon. A spring 94 is positioned between washer 92 and cymbal 82 to bias cymbal 82 towards and against cymbal 80. Outward movement of cymbal 82 on lever 84 is limited by the head 87 on lever 84. Washer 92 abuts a crank pin 96 which is received in a slot 97 formed in lever 84. The crank pin, as seen in FIG. 4A, has three offset portions including a first-end portion 98 pivotally mounted in a boss 100 on extension 91. The opposite end 102 of crank pin 96 is received in slot 97 of lever 84 and engages against washer 92.

The central offset portion 104 of pin 96 is captured in a slot 106 in a yoke element 108 mounted on casing extension 60. Yoke element 108 permits the crank to pivot in slot 106 but restricts fore and aft movement of a portion of pin 96 with neck block. As a result of this construction, when the neck block oscillates in a fore and aft direction, the lower end 98 thereof moves with extension 91 in the fore and aft direction. Because movement of crank pin segment 104 is restrained in yoke 108, the result is that the free end 102 of the pin swings in a direction opposite to extension 91. That is, when extension 91 moves forwardly with the neck block the upper end 102 of crank 96 moves rearwardly, and vice versa.

FIG. 4A shows the locked position of the neck block and corresponds, in plan view, to the position of the neck block shown in FIG. 3A. When slide element 68 is depressed, upon insertion of nipple 20 into mouth opening 18, the neck block is released for movement to and through the position shown in FIG. 3B.

FIG. 3B shows the position of cymbals and drive mechanism therefor as they appear when the neck block is in the position of FIG. 3B. From that position, continued oscillation of the neck block moves the neck block in a rearward direction, to the extreme upper position of the neck block, shown in FIG. 3C. FIG. 4C shows the corresponding position of the cymbals and drive therefor. The slidable mounting of cymbal 82 on lever 84 accomodates movement of that cymbal relative to the fixed cymbal 80.

Accordingly, it is seen that a relatively simply constructed doll is provided which will oscillate its head upon insertion of the bottle nipple in a doll's mouth while simultaneously producing a child-like sound, to simulate the noises produced by a child when sucking a bottle.

Although an illustrative embodiment of the present invention has been described herein with reference to the accompanying drawings, it is to be understood that the invention is not limited to that precise embodiment thereof, but that various changes and modifications may be effected therein by one skilled in the art without departing from the scope or spirit of this invention.

We claim:

1. A toy doll comprising, a body and a movable head thereon, said head having a mouth opening formed therein; drive means in said body for selectively oscillating said head in a forward and aft direction; said drive means including a neck block mounted in said head, rotary drive means in the doll's body, and pitman means drivingly engaged between said rotary drive means and neck block for oscillating the block in a forward and aft direction; locking means in said head for blocking oscillation of said neck block under the influence of said rotary drive means, said locking means being responsive to the insertion of an object in the doll's mouth opening to release said locking means, unblock movement of the neck block, and allow the drive means to oscillate said head; and means responsive to said oscillation of the doll's head for producing sounds.

2. A toy doll comprising, a body and a movable head thereon, said head having a mouth opening formed therein; drive means in said body for selectively oscillating said head in a forward and aft direction; locking means in said head for preventing operation of said drive means, said locking means being responsive to the insertion of an object in the doll's mouth opening to release said locking means and allow the drive means to oscillate said head; and means responsive to said oscillation of the doll's head for producing sounds; said drive means including a neck block mounted in said head, rotary drive means in the doll's body, and pitman means drivingly engaged between said rotary drive means and neck block for oscillating the block in a forward and aft direction; said locking means including a stop in said head connected to said body and a blocking slide slidably mounted in said head for oscillation therewith, said slide being located in alignment with said mouth opening for movement between first and second positions; said slide, in said first position being located to abut said stop and prevent oscillation of the neck block and, in said second position, being spaced from said stop.

3. A toy doll as defined in claim 2 including spring means for normally biasing said slide to said first position.

4. A toy doll as defined in claim 3 wherein said sound producing means comprising a pair of cymbals mounted on the neck block and means operatively connected between said neck block and body for moving at least one of said cymbals against and relative to the other cymbal to produce sound upon oscillation of said head.

5. A toy doll comprising, a body and a movable head thereon, said head having a mouth opening formed therein; drive means in said body for selectively oscillating said head in a forward and aft direction; locking means in said head for preventing operation of said drive means, said locking means being responsive to the insertion of an object in the doll's mouth opening to release said locking means and allow the drive means to oscillate said head; and means responsive to said oscillation of the doll's head for producing sounds; said sound producing means comprising a pair of cymbals mounted on the neck block and means operatively connected between said neck block and body for moving at least one of said cymbals against and relative to the other cymbal to produce sound upon oscillation of said head; said means for moving the at least one cymbal including a lever pivotally mounted on the neck block and secured to the at least one cymbal, a crank pivotally mounted on the neck block and having one end pivotally connected to said lever, said crank having an offset portion; and means in said head pivotally engaged with said offset portion and operatively connected to said body in a fixed position against movement whereby said crank is oscillated upon oscillation of the neck block to pivot said lever and move said at least one cymbal.

6. A toy doll comprising, a body, a head operatively connected to said body for oscillating movement in a fore and aft direction; said head having a mouth opening formed therein and a neck portion; a rigid neck block mounted in said neck portion; a drive motor in said body; means operatively engaged between said drive motor and said neck block for oscillating the neck block and head in said fore and aft direction; and releasable locking means in said head operatively engaged with said neck block for normally blocking oscillation of the head by said drive motor; said releasable locking means including means responsive to the insertion of an object in the doll's mouth opening to disengage the operative engagement between said locking means and the neck block and permit the drive motor to oscillate said head; and means responsive to oscillation of the doll's head for producing child-like sounds.

7. A toy doll as defined in claim 6 wherein said drive motor includes a rotary output drive member; and said means for oscillating the neck block comprises a drive transmission including an eccentric rotary output member and a pitman pivotally connected at one end of the neck block and at its opposite end being operatively engaged with said eccentric output member for oscillation thereby, whereby said neck block and head are oscillated upon operation of said drive means.

8. A toy doll as defined in claim 6 wherein said sound producing means comprises a pair of cymbals mounted on the neck block and means operatively connected between said neck block and body for moving at least one of said cymbals against and relative to the other cymbal to produce sound upon oscillation of said head.

9. A toy doll comprising, a body, a head operatively connected to said body for oscillating movement in a fore and aft direction; said head having a mouth opening formed therein and a neck portion; a rigid neck block mounted in said neck portion; a drive motor in said body, means operatively engaged between said drive motor and said neck block for oscillating the neck block and head in said fore and aft direction; and releasable locking means in said head for normally preventing oscillation of the head by said drive motor; said releasable locking means including means responsive to the insertion of an object in the doll's mouth opening to release said locking means and permit the drive motor to oscillate said head; and means responsive to oscillation of the doll's head for producing child-like sounds; said locking means including a stop positioned in said head and operatively connected to said body whereby the stop remains stationary relative to the head during oscillation thereof; said insertion responsive means comprising a blocking slide slidably mounted in said neck block for movement with the neck block and for sliding movement towards and away from the mouth opening; said slide having a free end located to overlie and engage said stop in said first position to prevent oscillation of said neck block and head by the drive motor and to be remote from said stop in said second position; and means for biasing said slide to said first position whereby said neck block is normally restrained against oscillation by said slide and is released for oscillation by the drive motor upon insertion of an object through the mouth opening to move said slide from said first to said second position.

10. A toy doll comprising, a body, a head operatively connected to said body for oscillating movement in a fore and aft direction; said head having a mouth opening formed therein and a neck portion; a rigid neck block mounted in said neck portion; a drive motor in said body, means operatively engaged between said drive motor and said neck block for oscillating the neck block and head in said fore and aft direction; and releasable locking means in said head for normally preventing oscillation of the head by said drive motor; said releasable locking means including means responsive to the insertion of an object in the doll's mouth opening to release said locking means and permit the drive motor to oscillate said head; and means responsive to oscillation of the doll's head for producing child-like sounds; said sound producing means comprising a pair of cymbals mounted on the neck block and means operatively connected between said neck block and body for moving at least one of said cymbals against and relative to the other cymbal to produce sound upon oscillation of said head; said means for moving the at least one cymbal including a lever pivotally mounted on the neck block and secured to the at least one cymbal, a crank pivotally mountd on the neck block and having one end pivotally connected to said lever, said crank having an offset portion; and means in said head pivotally engaged with said offset portion and operatively connected to said body in a fixed position against movement whereby said crank is oscillated upon oscillation of the neck block to pivot said lever and move said at least one cymbal.

* * * * *